US006978899B2

(12) United States Patent
Kokko

(10) Patent No.: US 6,978,899 B2
(45) Date of Patent: Dec. 27, 2005

(54) APPARATUS FOR SORTING WOOD CHIPS IN SEPARATE FRACTIONS

(75) Inventor: Pekka Kokko, Hollola (FI)

(73) Assignee: Andritz Oy, Helsinki (FI)

( * ) Notice: Subject to any disclaimer, the term of this patent is extended or adjusted under 35 U.S.C. 154(b) by 200 days.

(21) Appl. No.: 10/380,881

(22) PCT Filed: Sep. 19, 2001

(86) PCT No.: PCT/FI01/00816

§ 371 (c)(1),
(2), (4) Date: Mar. 19, 2003

(87) PCT Pub. No.: WO02/24352

PCT Pub. Date: Mar. 28, 2002

(65) Prior Publication Data

US 2004/0011708 A1 Jan. 22, 2004

(30) Foreign Application Priority Data

Sep. 20, 2000 (FI) ..... 20002070

(51) Int. Cl.[7] ..... B07C 5/00
(52) U.S. Cl. ..... 209/639; 209/644
(58) Field of Search ..... 209/44.2, 631, 209/638, 639, 641, 644, 696, 911, 136, 138

(56) References Cited

U.S. PATENT DOCUMENTS 1,530,277 A * 3/1925 Mettler, Sr. ..... 209/137
1,888,372 A 11/1932 Bramwell
3,044,619 A * 7/1962 Knolle ..... 209/33
3,945,915 A * 3/1976 Wilson ..... 209/44.1
4,486,300 A 12/1984 Prieb ..... 209/135
5,205,415 A * 4/1993 Surtees ..... 209/21
5,725,102 A * 3/1998 Gustavsson ..... 209/143
6,283,300 B1 * 9/2001 Bielagus et al. ..... 209/29

FOREIGN PATENT DOCUMENTS

DE 299 01 453 U1 9/1999
FR 693962 9/1930

OTHER PUBLICATIONS

International Search Report for International Patent No. PCT/FI 01/00816, completed Dec. 11, 2001.

* cited by examiner

*Primary Examiner*—Donald P. Walsh
*Assistant Examiner*—Joseph C. Rodriguez
(74) *Attorney, Agent, or Firm*—Alix, Yale & Ristas, LLP

(57) ABSTRACT

An apparatus for sorting wood chips includes a feeder for supplying wood chips onto a sloping support surface to slide along the support surface over a slit extending thereacross. The slit is configured to provide an impulse action by means of a continuous gas flow on the chips or the fines particles presently in line with the slit. The bottom end of the support surface upstream of the slit is provided with a section (a) diverging from the rest of the support surface in terms of its gradient, over which section an angle of inclination (β) relative to the horizontal plane is smaller than an angle of inclination (α) of the support surface upstream of the same in the advancing direction of the wood chips.

13 Claims, 2 Drawing Sheets

APPARATUS FOR SORTING WOOD CHIPS IN SEPARATE FRACTIONS

CROSS REFERENCE TO RELATED APPLICATIONS

This application is the National Stage of International Application No. PCT/FI01/00816 filed Sep. 19, 2001 and claims the benefit of Finnish Patent Application No. 20002070, filed Sep. 20, 2000.

BACKGROUND OF THE INVENTION

1. Field of the Invention

The invention relates to an apparatus for sorting wood chips and more particularly to an apparatus for sorting wood chips according to their surface to weight ratio or thickness.

2. Description of the Related Art

The invention relates to the sorting of wood chips having a variety of sizes and similar, substantially hexahedral shapes having a length and a width, as well as a thickness substantially less than the latter, and possibly fines particles, by means of an impulse action such that the excess thickness chips or the fines particles, or both the excess thickness chips and the fines particles are separated to form a separate fraction. The miscellaneous chips and the fines particles being sorted from each other by means of one or more separating walls arranged to comply with various trajectories imparted to the wood chips by means of the impulse action. An apparatus of this type comprising a feeder for supplying the wood chips onto a sloping support surface and for sliding the same along said support surface over a slit extending thereacross, said slit being adapted to provide an impulse action therethrough by means of a continuous gas flow on the chips or the fines particles as they pass over the slit.

An apparatus of the above type is known from the Applicant's Finnish utility model No. 3899. Such an apparatus is intended for the separation of various fractions from a major mass flow of wood chips (hundreds of bulk cubic meters an hour in volume), as determined by chip thickness. At the same time, it also enables the separation of higher density stuff, such as scrap, as well as irregularly shaped harmful particles, the same way as fines particles. This type of separation is needed in pulp production for processing feed stock.

In this type of apparatus, a plane defined by the width and length of a chip is subjected to a dynamic gas pressure (in practice atmospheric pressure) for a given short period for creating a constant effect per unit area. This results in an impulse action, which brings about a change of velocity for the chip as follows: force=pressure×area or $F=pA$, impulse=force×application time or $I=Ft$, and change of velocity=impulse/mass or $dv=I/m \Rightarrow dv=pAt/m$. Since the mass of a chip is dependent on its volume, which is dependent on thickness and area and, on the other hand, the impulse is dependent on area, the entity will be independent of the width and length of a chip, whereby the change of velocity is dependent on a thickness dimension as the material density is constant, such that the ratio of changes in velocity is inversely proportional to the ratio of thicknesses. With this change of velocity, the chips are caused to travel in the direction of a thickness dimension over varying distances, while travelling in longitudinal or lateral direction at the same velocity over the same distance.

Alternatively, this type of apparatus can be understood to sort wood chips according to their surface to weight ratio.

Wood chips having the same length and width, but different thicknesses will have different surface to weight ratios. Thicker chips will have a smaller surface to weight ratio than thin chips. The change in velocity and direction resulting from exposure to an impulse action of gas pressure for a thick chip with a small surface to weight ratio will be less than the change of velocity and direction of a thinner chip with a greater surface to weight ratio exposed to the same impulse action. This type of sorting is most effective when the largest area surface of the chips are exposed to the impulse action.

The application of an impulse action or effect on a desired chip surface requires that the chips be directed to have their largest area surface facing perpendicularly the application direction of a dynamic pressure. The establishment of a given application time requires that the chips travel at the same speed across the pressure application site of a given size.

The chips slide along a sloping plane over a given distance for a time sufficient to set themselves in a proper position and to attain a given velocity. At this speed, the chips slide across a narrow slit, the air flowing therefrom applying its dynamic pressure to provide an impulse effect or action. The chips fly freely in the airspace, thus having a common speed component downwards and, consistent with the above calculation, a thickness-specific speed in horizontal direction, whereby the chips of non-uniform thicknesses fly to various distances from the site of impulse action: thinner chips fly farther away.

High-density scrap particles (e.g. steel has a density which is about tenfold in comparison to solid density of wood) have just a slight change of speed, and the same applies to irregularly shaped particles, due to aerodynamic properties. This way, such particles can be separated from a flow of chips in a single process. Respectively, fine dust particles obtain a major change of speed, due to a thickness dimension being very small. Consequently, dust separates effectively to form a separate flow.

Various fractions are collected from the separated flow of chips by setting up partitions or separating walls in appropriate places. The partitions can be adjustable for varying the chips content of fractions, as necessary. This also enables the implementation of a resorting process for a desired fraction by the same method.

In comparison to other equipment known from the prior art, this type of apparatus requires less maintenance, the number of moving parts being radically reduced. Mechanical strength is also improved throughout the apparatus by virtue of a minor fatigue stress, especially the fact that no reciprocating or gyroscopic motion is necessary. In terms of its adjustability, the apparatus can be designed to be easier and quicker than those available at present.

The support surface for sliding wood chips along for sorting the same in a variety of fractions must be set at a relatively large angle relative to the horizontal plane. Thus, an air cushion develops easily between individual chips and the support surface, having an adverse effect on the apparatus in terms of its operation, since the strength of impulse action upon a single chip thus fluctuates extensively, depending on the air cushion thickness. Therefore, the apparatus does not have a best possible sorting capacity.

SUMMARY OF THE INVENTION

It is an object of the invention to provide an apparatus, wherein chips sliding along a support surface set firmly against the support surface, particularly just upstream of a slit for applying an impulse action thereto.

According to the invention, this object is achieved in such a way that, and an apparatus of the invention is characterized in that the support surface has its bottom end upstream of the slit provided with a section diverted from the rest of the support surface in terms of its gradient, over which section an angle of inclination relative to the horizontal plane is smaller than an angle of inclination of the support surface upstream of the same in the advancing direction of wood chips.

In this type of solution, the chips are subjected to a centrifugal force for making sure that the chips set firmly against said support surface. The arrangement guarantees conditions favourable in terms of applying an impulse force to chips in the region of an impulse-action producing slit and, hence, in terms of an intended operation of the apparatus, the chips assuming a trajectory determined by the thickness thereof.

The centrifugal force is preferably produced by means of a curved section provided on the support surface, wherein the chips are forced evenly against the support surface in such a way that, upon hitting the support surface, the chips do not take a ricochet from said surface.

The curved surface may have an extension upstream of the impulse-action producing slit, which is constituted by a flat surface and which can be used for further assisting chips to arrive at the impulse-force applying slit in a precisely correct orientation.

The curved section of a support surface, as well as the eventual flat surface downstream thereof, must have a length which is small relative to the overall length of the support surface for a deceleration effect applied to the chips not to become excessive. For the same reason, the surface has a radius of curvature with a certain minimum value, which should not be missed. An excessively small radius of curvature immediately downstream of the flat section also results in a ricochet effect, whereby the chip disengages from the support surface and the desired action is not accomplished.

In yet another preferred embodiment of the invention, the arrangement is such that said section of a different gradient is dimensioned in such a way that the wood chips presently travelling therealong are subjected in a direction perpendicular to the surface of said section to a force having a strength at least equal to earth gravity, most preferably 2–4 G.

BRIEF DESCRIPTION OF THE DRAWINGS

The invention will now be described in more detail with reference to the accompanying drawings, in which.

DETAILED DESCRIPTION OF AN EXEMPLARY EMBODIMENT

Figure 1:
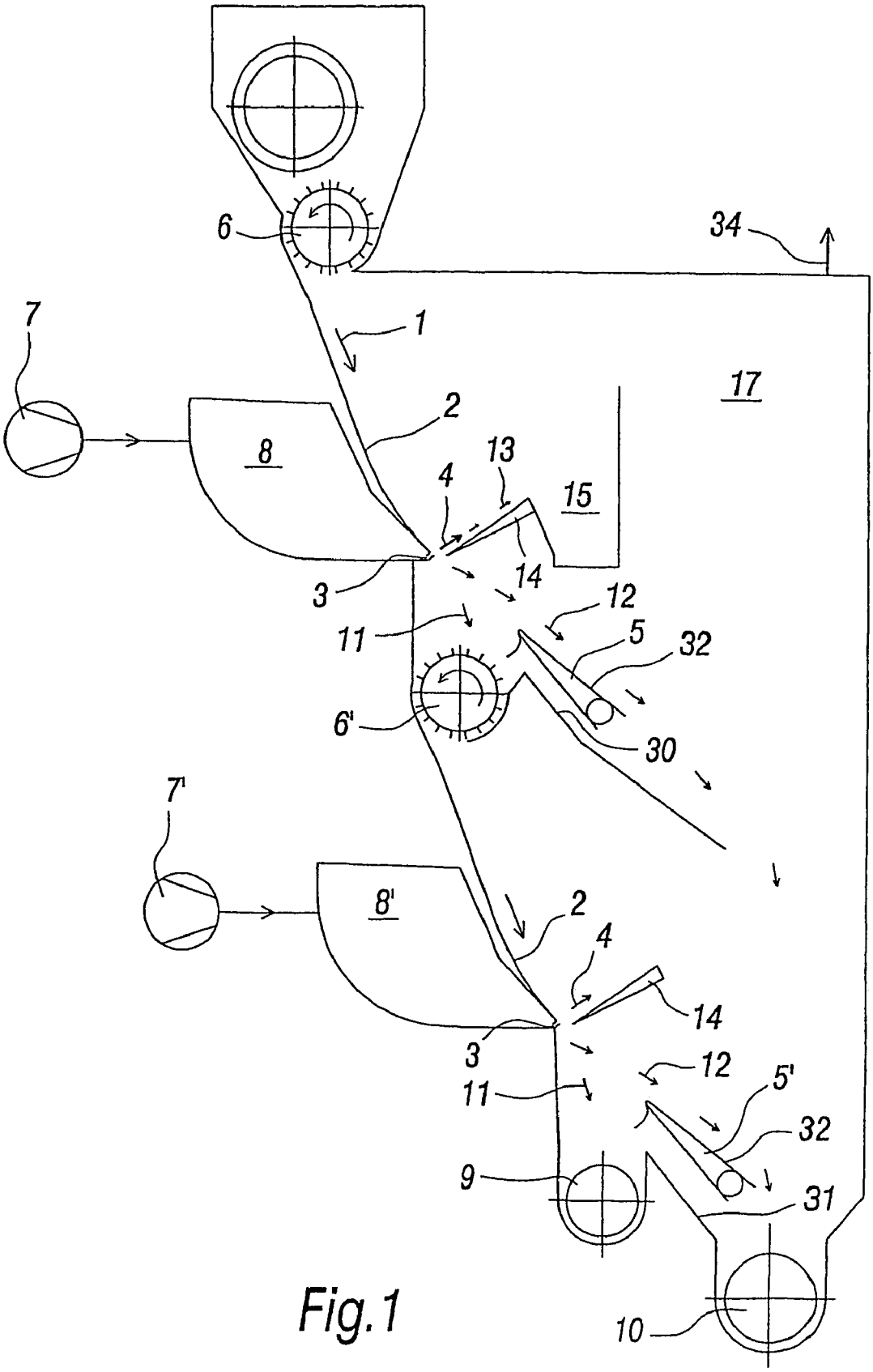
FIG. 1 shows an apparatus of the invention in a schematic section.

FIG. 1 shows schematically an apparatus for sorting wood chips 1 in separate fractions. Fines particles 13, possibly contained in the wood chips 1, are sorted out to form a separate fraction and individual chips 11, 12 are determined by the thickness thereof as excessively thick chips 11 (reject) and accepted chips 12 (accept). The surface to weight ratio of the chips may be understood to be a proxy for the thickness of the chips. Thick chips will have a smaller surface to weight ratio than thin chips having approximately the same length and width.

The apparatus comprises a feeder 6 for supplying the wood chips 1 onto a sloping support surface 2 for a substantially single layer. The individual chips 11, 12 settle in a natural way on the support surface 2 to rest upon the largest surface thereof, i.e. in the case of wood chips, upon the longitudinal/lateral surface thereof.

The support surface 2 is a solid, flat, and durable level surface, which forms a steeply sloping slide surface for the wood chips 1 to be sorted.

The wood chips 1 emerging from the feeder 6 slide down the sloping support surface 2 and then over a slit 3 arranged across the support surface, said slit being adapted to deliver an impulse action 4 directed away from said support surface 2 and applied to one or more chips 11, 12 or fines particles 13 presently in line with the slit. The impulse action is adapted to be produced by means of a gas flow 4, preferably a flow of air. The impulse action 4 may have a direction which is perpendicular to the support surface 2, or also at an oblique angle relative to the support surface 2.

The flow of air is generated by a fan 7. In order to secure uniformity of the impulse action 4, a nozzle chamber 8 is arranged between the fan 7 and the slit 3.

The individual chips 11, 12 of varying thickness and the eventual fines particles 13 are separated from each other in accordance with various trajectories provided by the impulse action 4 for the particles to be sorted. The fines particles 13, which are smaller in size than the width of the slit 3, obtain a maximum change of velocity and, thus, are deflected by the action of a guide/baffle 14 in a separate fraction into a chute 15.

The individual chips 11, 12, which are substantially larger in size than the width of the slit 3 and, thus, heavier than said fines particles 13, obtain a change of velocity substantially less significant than that of the fines particles 13 when present in line with the slit 3. A pressure-generated impulse sends the individual chips 11, 12 flying in different trajectories defined by thickness of the chips, and the flow of chips is divided in separate fractions by means of a separating wall 5. The averagely thinnest chips 12 (corresponding to a large surface to weight ratio) fly over the separating wall 5 and are further guided to a discharge screw 10. Respectively, the averagely thickest chips 11 (corresponding to a small surface to weight ratio) fly a shorter distance and fall into a feeder 6' present between the separating wall 5 and the slit 3.

In the illustrated example, the averagely thickest chips 11 received in the feeder 6' are reprocessed in a lower second apparatus, whereby a fraction thereof (the averagely lightest fraction) is guided over a separating wall 5' further onto the discharge screw 10, and another fraction (the averagely heaviest fraction) falls into a chute present between the separating wall 5' and the slit 3 and provided with a discharge screw 9.

Processing of the wood chips 1 is overall adapted to take place in a dustproof treatment chamber 17, the discharge of air being effected through an opening indicated by reference numeral 34.

Figure 2:
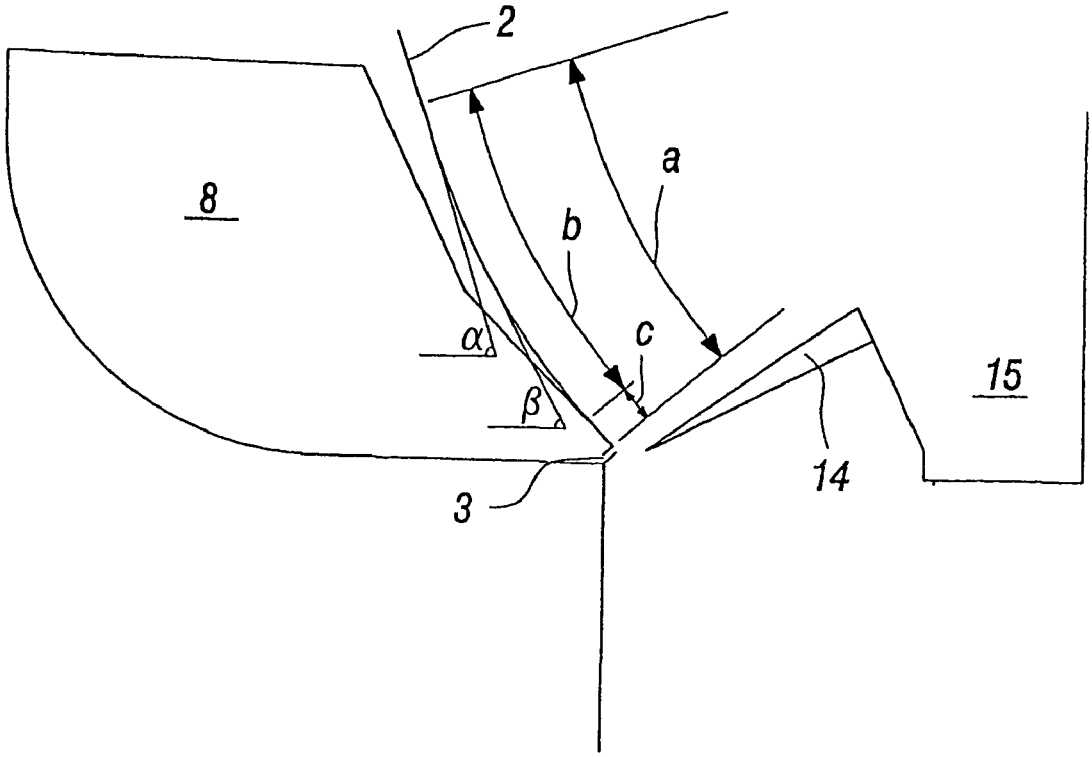
FIG. 2 shows the apparatus of FIG. 1 over the region of a nozzle slit in a larger scale.

As best shown in FIG. 2, the support surface 2 has its bottom end upstream of the slit 3 provided with a section a divergent from the rest of the support surface 2 in terms of gradient. This section a has an angle of inclination β relative to the horizontal plane, which is smaller than an angle of inclination a of the support surface 2 upstream thereof in the advancing direction of the wood chips 1. Most preferably, this is brought about in such a way that said diverging gradient section a is constituted by a curved surface.

As a result, the wood chips 1 to be treated or processed are subjected to a centrifugal force, whereby it is secured that the individual chips 11, 12 as well as the fines particles 13 set firmly against said support surface 2. The arrangement guarantees favourable conditions for applying an impulse force, particularly to the individual chips 11, 12 as they pass over the impulse-action generating slit 3. Thus, the apparatus is secured in terms of its appropriate operation, whereby the individual chips 11, 12 assume a trajectory defined by the thickness thereof.

As shown in the example of FIG. 2, the curved surface a may be constituted by a curved section b, and by a flat section c serving as its extension. This is a further contribution to bringing the individual chips 11, 12 to the region of the impulse-force applying slit 3 in an exactly correct orientation.

The section a, which is different from the rest of the support surface 2 in terms of its gradient (slope) and which thus generates a centrifugal force, must be given a length which is relatively short in comparison to the overall length of the support surface 2 in order to avoid the application of an excessive deceleration effect on the individual chips 11, 12.

The section a must not have an excessively sharp divergence or deflection, either, in order not to create a ricochet or rebound effect that would cause the individual chip 11, 12 to disengage from the support surface 2, and the desired effect would be missed.

Said diverging gradient section a is most preferably dimensioned in such a way that the wood chips 1 travelling therealong are subjected in a direction perpendicular to the surface of said section a to a force having a strength at least equal to earth gravity, most preferably 2–4 G.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. An apparatus for sorting wood chips, said apparatus of the type involving chips in a variety of sizes and similar, substantially hexahedral pieces having a length and a width, as well as a thickness substantially less than the width, and possibly fines particles, by means of an impulse action such that the excess thickness chips or the fines particles, or both the excess thickness chips and the fines particles are separated from the wood chips to form a separate fraction, the miscellaneous chips and the fines particles being sorted from each other by means of one or more separating walls arranged to comply with various trajectories established by means of the impulse action, said apparatus comprising:

a feeder providing controlled release of said wood chips onto a sloping support surface to slide along said support surface over a slit extending thereacross, said slit being configured to provide an impulse action therethrough which is essentially perpendicular to both the advancing direction of the wood chips and the support surface adjacent the slit, by means of a continuous gas flow on the chips or the fines particles presently in line with the slit, said feeder delivering the chips to the top end of the support surface in a substantially single layer, such that, in the process of sliding in contact with the support surface, a longitudinal/lateral surface of the chips is set against said support surface, wherein said support surface has its bottom end upstream of the slit provided with a section (a) diverging from the rest of said support surface in terms of its gradient, over which section an angle of inclination (β) relative to the horizontal plane is smaller than an angle of inclination a of the support surface upstream of the same in the advancing direction of the wood chips, said diverging gradient section (a) being dimensioned in such a way that the wood chips travelling therealong are subjected in a direction perpendicular to the surface of said section (a) to a force having a strength at least equal to earth gravity.

2. The apparatus as set forth in claim 1, wherein said diverging gradient section (a) is constituted by a curved surface.

3. The apparatus as set forth in claim 1, wherein said diverging gradient section (a) is constituted by a curved surface (b), and by a flat surface (c) serving as its extension.

4. The apparatus as set forth in claim 1, wherein said diverging gradient section (a) has a length which is small relative to the overall length of the support surface.

5. The apparatus as set forth in claim 1, wherein said force is in the range of 2–4 times earth gravity.

6. An apparatus for sorting wood chips having a variety of surface to weight ratios into a plurality of fractions according to said surface to weight ratio, said apparatus comprising:

a sloping support surface having an upper portion arranged at an angle of inclination α relative to a horizontal plane and a lower portion arranged at an angle of inclination β relative to a horizontal plane, said lower portion extending between said upper portion and a bottom edge of said support surface;

a feeder arranged to feed said wood chips onto said upper portion to slide down said support surface and over said lower portion in a substantially single layer;

a substantially uniform and continuous flow of gas through a gas flow outlet in the form of a slit extending laterally across said support surface adjacent said bottom edge, said gas flow outlet configured to impart a direction to said flow of gas that is substantially perpendicular to said support surface lower portion adjacent said bottom edge and the advancing direction of the wood chips, wherein said angle β is smaller than said angle a such that said wood chips are subjected to a centrifugal force directing the wood chips toward said support surface, said centrifugal force having a value at least equal to earth gravity, wood chips passing over said slit are exposed to said flow of gas, said flow of gas imparting trajectories to said wood chips that vary according to the surface to weight ratio of said wood chips.

7. The apparatus of claim 6, wherein said fractions are sorted by means of at least one separating wall positioned to separate chips having a first trajectory from chips having a second trajectory.

8. The apparatus of claim 6, wherein the centrifugal force has a value of between 2 and 4 times earth gravity.

9. The apparatus of claim 6, wherein said lower portion comprises a curved surface.

10. The apparatus of claim 6, wherein said lower portion comprises a curved segment extending from said upper portion to a planar segment adjacent said bottom edge.

11. The apparatus of claim 6, wherein a majority of said wood chips have a substantially hexahedral shape comprising a length, a width and a thickness, the surface to weight ratio of said majority of said wood chips being primarily a function of the thickness of said wood chips and sorting said wood chips into fractions according to surface to weight ratio corresponds to sorting said wood chips into fractions according to said thickness.

12. The apparatus of claim 6, wherein said support surface has a first length measured between said feeder and said bottom edge and said lower portion has a second length measured between said upper portion and said bottom edge that is small relative to said first length.

13. The apparatus of claim 6, wherein said gas flow outlet imparts a direction to said flow of gas that is defined by an oblique angle relative to the support surface lower portion adjacent said bottom edge.

* * * * *

UNITED STATES PATENT AND TRADEMARK OFFICE

CERTIFICATE OF CORRECTION

PATENT NO. : 6,978,899 B2
APPLICATION NO. : 10/380881
DATED : December 27, 2005
INVENTOR(S) : Kokko It is certified that error appears in the above-identified patent and that said Letters Patent is hereby corrected as shown below:

Column 6:

Line 48, after “angle” (second occurrence) delete “a” and substitute --α--.

Signed and Sealed this

Thirty-first Day of October, 2006

JON W. DUDAS
*Director of the United States Patent and Trademark Office*